US006562530B2

(12) United States Patent
Morikawa et al.

(10) Patent No.: US 6,562,530 B2
(45) Date of Patent: May 13, 2003

(54) ELECTROPHOTOGRAPHIC PHOTOSENSITIVE MEMBER, AND PROCESS CARTRIDGE AND ELECTROPHOTOGRAPHIC APPARATUS HAVING THE ELECTROPHOTOGRAPHIC PHOTOSENSITIVE MEMBER

(75) Inventors: Yosuke Morikawa, Kanagawa (JP); Kouichi Nakata, Shizuoka (JP); Kimihiro Yoshimura, Kanagawa (JP); Daisuke Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/883,396

(22) Filed: Jun. 19, 2001

(65) Prior Publication Data

US 2002/0045116 A1 Apr. 18, 2002

(30) Foreign Application Priority Data

Jun. 21, 2000 (JP) ..... 2000-186204

(51) Int. Cl.[7] ..... G03G 5/14
(52) U.S. Cl. ..... 430/66; 430/67; 399/262
(58) Field of Search ..... 430/66, 67, 56; 399/262

(56) References Cited

U.S. PATENT DOCUMENTS

| | | | | |
|---|---|---|---|---|
| 5,059,502 A | | 10/1991 | Kojima et al. | 430/66 |
| 5,910,386 A | * | 6/1999 | Yoshinaga et al. | 430/66 |

FOREIGN PATENT DOCUMENTS

| | | |
|---|---|---|
| EP | 0606035 | 7/1994 |
| JP | 57-30846 | 2/1982 |
| JP | 2000/10320 | 1/2000 |

* cited by examiner

*Primary Examiner*—John Goodrow
(74) *Attorney, Agent, or Firm*—Fitzpatrick, Cella, Harper & Scinto

(57) ABSTRACT

An electrophotographic photosensitive member has, in this order, a support, a photosensitive layer and a protective layer. The thickness d ($\mu$m) of the protective layer, the universal hardness Hu-1 (N/mm$^2$) of the protective layer, and the universal hardness Hu-2 (N/mm$^2$) of the photosensitive layer after peeling off the protective layer satisfy the following expression (1):

$$5.8\times d+Hu\text{-}2 \leqq Hu\text{-}1 \leqq -2.45\times d^2+44.4\times d+Hu\text{-}2 \quad (1).$$

Also disclosed are a process cartridge and an electrophotographic apparatus which have the above electrophotographic photosensitive member.

15 Claims, 5 Drawing Sheets

ELECTROPHOTOGRAPHIC PHOTOSENSITIVE MEMBER, AND PROCESS CARTRIDGE AND ELECTROPHOTOGRAPHIC APPARATUS HAVING THE ELECTROPHOTOGRAPHIC PHOTOSENSITIVE MEMBER

BACKGROUND OF THE INVENTION

1. Field of the Invention

This invention relates to an electrophotographic photosensitive member, and a process cartridge and an electrophotographic apparatus which have the electrophotographic photosensitive member.

2. Related Background Art

Electrophotographic photosensitive members are repeatedly put to means for charging, exposure, development, transfer, cleaning and charge elimination. An electrostatic latent image formed upon charging and exposure is made into a toner image by the use of a fine-particle developer called a toner. This toner image is further transferred to a transfer medium such as paper by a transfer means, where the toner of the toner image is not all transferred, but partly remains on the surface of the photosensitive member.

The remaining toner (residual toner) is removed by a cleaner, or, on account of the advancement of cleanerless techniques in recent years, the residual toner is collected by what is called a cleaning-at-development system in which any independent cleaning means is not provided and the residual toner is collected through a developing means.

Electrophotographic photosensitive members, to which electrical and mechanical external forces as stated above are directly applied, are also required to have durability to such forces. Stated specifically, they are required to have durability to the occurrence of surface wear and scratches due to friction and durability to the deterioration of surface layer that is caused by adhesion of active substances such as ozone and NOx generated at the time of charging.

To meet such requirements imposed on electrophotographic photosensitive members, it has been attempted to provide protective layers of various types. In particular, protective layers composed chiefly of resins have been proposed in a large number. For example, as disclosed in Japanese Patent Application Laid-open No. 57-30846, a protective layer is proposed which is formed of a resin to which a metal oxide is added as conductive particles so that its resistance can be controlled.

Such conductive particles are dispersed in the protective layer of an electrophotographic photosensitive member chiefly in order to control the electrical resistance of the protective layer itself to prevent residual potential from increasing in the photosensitive member as the electrophotographic process is repeatedly used. It is known that suitable resistance values of protective layers for electrophotographic photosensitive members are $10^{10}$ to $10^{15}$ Ω·cm. In respect of abrasion wear due to repeated used, it is advantageous for the mass ratio of the mass (P) of conductive particles to the mass (B) of binder resin, P/B, to be smaller, i.e., for the binder resin to be in a larger quantity than the conductive particles.

Meanwhile, in a protective layer containing a charge-transporting material, the mass ratio of the mass (D) of charge-transporting material to the mass (B) of binder resin, D/B, is about 2/1 to 1/2, in order for the layer to have a low residual potential. In general, its residual potential can be made smaller by making the value of D/B larger, but this may cause a great abrasion for the film of a protective layer, or, when a curable resin is used, the curing of the curable resin may be inhibited.

As stated above, in recent years studies are being made on how to improve the performance of electrophotographic photosensitive members with resort to protective layers. However, compared with the thickness of usual photosensitive layers which is tens of μm, the thickness of protective layers is usually as small as a few μm. Thus, in order to maintain the like durability, it is, of course, necessary for the protective layers to be more kept from being scratched and abraded. Accordingly, studies are being made on protective layers the resin of which is replaced with a curable resin, and efforts are made on how to make the layer harder and less abrasive. However, with progress of studies actually made taking note of only the hardness, it has been realized that although the layer is hard, it tends to be scratched to have a poor durability after all, or although it is not so hard, it is well balanced with abrasion wear to bring about an improvement in durability in total.

Too low hardness also makes the abrasion wear worse as a matter of course. Especially when continuing to use a layer having not so high hardness in spite of the use of a curable resin, black dots may occur if a reverse development system is used. Such black dots differ from black dots having ever come into question, and are caused neither by simple injection of holes from the support nor by generation of holes due to heat or electric field generated from a charge generation layer even at the initial stage. This has become apparent as a result of studies made by the present inventors. The real cause of such black dots has not been regretfully elucidated, but it has been realized at least that the black dots occur after extensive operation on thousands to tens of thousands of sheets when a photosensitive member is used which has the photosensitive layer and the protective layer on a conductive support and also that they occur when the protective layer has a specific hardness.

SUMMARY OF THE INVENTION

An object of the present invention is to provide an electrophotographic photosensitive member which has a surface layer free of cracks and having a superior durability to the occurrence of surface wear and scratches, does not cause black dots upon running (or extensive operation) which are inherent in the electrophotographic photosensitive member having the above protective layer, and can maintain a high-grade image quality; and also to provide a process cartridge and an electrophotographic apparatus which have such an electrophotographic photosensitive member.

To achieve the above object, the present invention provides an electrophotographic photosensitive member comprising a support, and a photosensitive layer and a protective layer which have been formed on the support in this order;

a thickness d (μm) of the protective layer, a universal hardness Hu-1 ($N/mm^2$) of the protective layer, and a universal hardness Hu-2 ($N/mm^2$) of the photosensitive layer as measured after the protective layer is peeled off satisfying the following expression (1):

$$5.8\times d+Hu\text{-}2 \leqq Hu\text{-}1 \leqq -2.45\times d^2+44.4\times d+Hu\text{-}2 \quad (1).$$

The present invention also provides a process cartridge comprising an electrophotographic photosensitive member and at least one means selected from the group consisting of a charging means, a developing means and a cleaning means;

the electrophotographic photosensitive member and at least one means being supported as one unit and being detachably mountable on the main body of an electrophotographic apparatus; and the electrophotographic photosensitive member comprising a support, and a photosensitive layer and a protective layer which have been formed on the support in this order;

a thickness d (μm) of the protective layer, a universal hardness Hu-1 (N/mm$^2$) of the protective layer, and a universal hardness Hu-2 (N/mm$^2$) of the photosensitive layer as measured after the protective layer is peeled off satisfying the following expression (1):

$$5.8\times d+Hu\text{-}2\leqq Hu\text{-}1\leqq -2.45\times d^2+44.4\times d+Hu\text{-}2 \quad (1).$$

The present invention still also provides an electrophotographic apparatus comprising an electrophotographic photosensitive member, a charging means, an exposure means, a developing means and a transfer means;

the electrophotographic photosensitive member comprising a support, and a photosensitive layer and a protective layer which have been formed on the support in this order;

a thickness d (μm) of the protective layer, a universal hardness Hu-1 (N/mm$^2$) of the protective layer, and a universal hardness Hu-2 (N/mm$^2$) of the photosensitive layer as measured after the protective layer is peeled off satisfying the following expression (1):

$$5.8\times d+Hu\text{-}2\leqq Hu\text{-}1\leqq -2.45\times d^2+44.4\times d+Hu\text{-}2 \quad (1).$$

DESCRIPTION OF THE PREFERRED EMBODIMENTS

Figure 1:
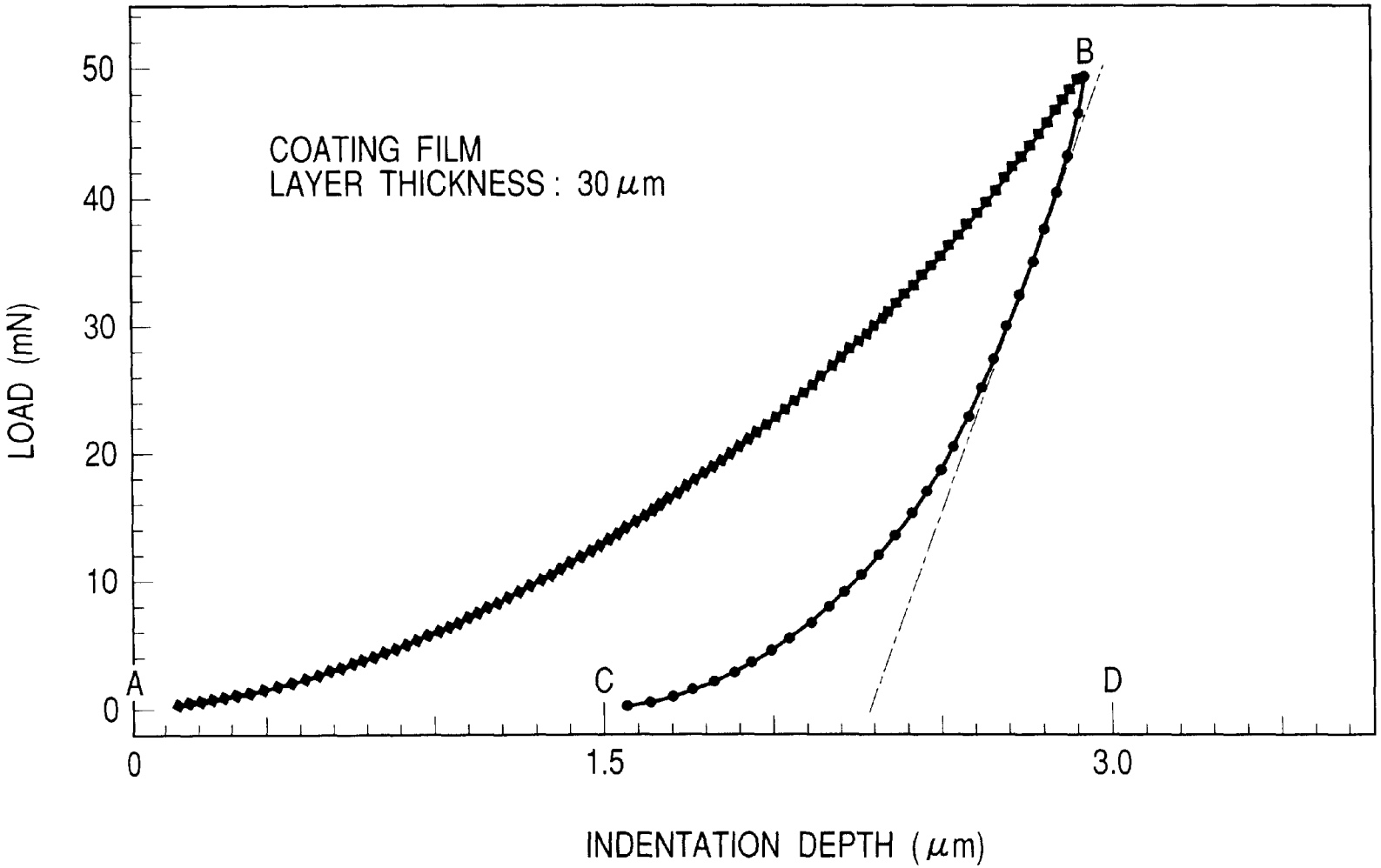
FIG. 1 is a chart of measurement with a Fischer hardness meter.

The electrophotographic photosensitive member of the present invention has, in this order, a support, a photosensitive layer and a protective layer, wherein a thickness d (μm) of the protective layer, a universal hardness Hu-1 (N/mm$^2$) of the protective layer, and a universal hardness Hu-2 (N/mm$^2$) of the photosensitive layer after peeling off the protective layer satisfy the following expression (1):

$$5.8\times d+Hu\text{-}2\leqq Hu\text{-}1\leqq -2.45\times d^2+44.4\times d+Hu\text{-}2 \quad (1).$$

In addition, in the present invention, it is preferred that a thickness d (μm) of the protective layer, an elastic deformation rate We-1 (%) of the protective layer, and an elastic deformation rate We-2 (%) of the photosensitive layer after peeling off the protective layer satisfy the following expression (2):

$$-0.71\times d+We\text{-}2\leqq We\text{-}1\leqq -0.247\times d^2+4.19\times d+We\text{-}2 \quad (2).$$

In the present invention, the universal hardness Hu and the elastic deformation rate We (%) are measured with a hardness meter H100VP-HCU (trade name), manufactured by Fischer Instruments Co., Germany. This is hereinafter called a Fischer hardness meter. The measurements were all made under a 23° C. and 55% RH environment.

The Fischer hardness meter is not a means in which an indenter is pressed into the surface portion of a sample and any indentation remaining after the load has been removed is measured with a microscope as in the conventional Microvickers method, but a means in which a load is continuously applied to an indenter and the depth of indentation under application of the load is directly measured to determine continuous hardness.

The universal hardness Hu is defined in the following way: Using a diamond indenter (Vickers indenter) which is a quadrangular-pyramid diamond indenter with an angle between its opposite faces of 136°, the depth of indentation under application of a test load is measured. The universal hardness Hu is indicated by a ratio that the test load is divided by the surface area of the impression (calculated from the geometric shape of the indenter) produced at the test load, and is expressed by the formula (3):

$$Hu\ (N/mm^2)=\{\text{test load } (N)\}/\{\text{surface area } (mm^2) \text{ of Vickers indenter under application of test load}\}=F/(26.43\times h^2) \quad (3)$$

where;

F is the test load (N); and h is the indentation depth (mm) under application of the test load.

The measurement with the hardness meter is made under the conditions that load is applied to the quadrangular-pyramid diamond indenter with an angle between its opposite faces of 136° to indent it by 1 μm depth into the film to be measured, and the indentation depth in a state of the load application is electrically detected and read out. An example in which measurements were made at the indentation depth of 3 μm is shown in FIG. 1. The measurements are plotted with indentation depth (μm) as abscissa and load L (mN) as ordinate. The load L and indentation depth obtained here are substituted for F and h, respectively, in the expression (3) to determine the universal hardness Hu.

The elastic deformation rate is determined in the following way: Load is applied to the above diamond indenter to indent it by 1 μm depth into the film, then, while the load is reduced down to 0 (zero), the indentation depth and load are measured. In FIG. 1 in the above example, it comes to be A→B→C. Here, the work done We (nJ) for elastic deformation is represented by the area enclosed with C-B-D-C in FIG. 1, and the work done Wr (nJ) for plastic deformation is represented by the area enclosed with A-B-C-A in FIG. 1, thus the elastic deformation rate We (%) is expressed by the expression (4).

$$We(\%)-\{We/(We+Wr)\}\times 100 \quad (4)$$

In general, elasticity is the property of restoring a strain (deformation) caused by external force to the original. The plastic deformation area is the portion remaining deformed due to the load applied beyond elastic limit or other effects even after an external force is removed. Namely, it means that the larger the value of the elastic deformation rate We (%) is, the larger the elastic deformation area is, and the smaller the value of We (%) is, the larger the plastic deformation area is.

Figure 2:
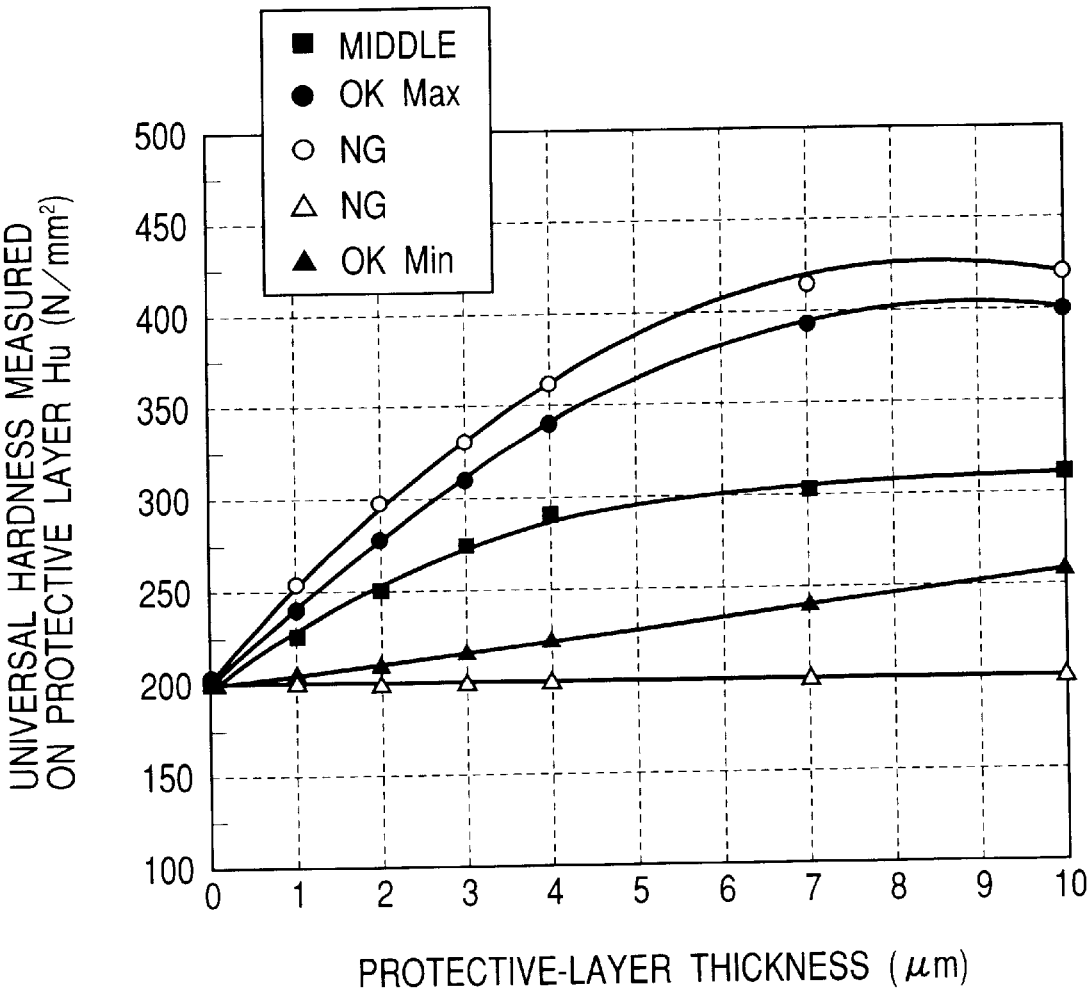
FIG. 2 is a chart showing Fischer hardness measured on protective layers.

In the present invention, in respect of the electrophotographic photosensitive member having a photosensitive layer and a protective layer formed thereon, the universal hardness Hu-1 of the protective layer is measured on the protective layer with the Fischer hardness meter and the universal hardness Hu-2 of the photosensitive layer is also measured on the photosensitive layer after peeling off the protective layer. Based on the Hu-1 and Hu-2 thus measured, they are related to each other. As a result of the measurement of the universal hardness of each of the protective layer and the photosensitive layer, as shown in FIG. 2, curves were drawn passing through the universal hardness of the underlying photosensitive layer (the position of a protective layer thickness of 0) and depending on the protective layer thickness.

The right-hand member ($-2.45\times d^2+44.4\times d+Hu-2$) shown in the expression (1) is an approximate expression obtained from the results of Examples. There is no problem until the universal hardness Hu-1 of the protective layer exceed this value, but if exceeding it, cracks may occur. The left-hand member ($5.8\times d+Hu-2$) shown in the expression (1) is also an approximate expression obtained from the results of Examples. This is a linear expression with respect to the layer thickness because the approximation was feasible in substantially straight lines up to 1 to 7 $\mu$m corresponding to the proper layer thickness of the protective layer. There is no problem when the universal hardness Hu-1 is in a value greater than the value of this left-hand member. If it is in a value smaller than that, the layer may, of course, greatly be abraded with running. Even though the resin used in the protective layer is a curable resin, black dots may occur with running if the universal hardness Hu-1 is in a value smaller than the value of the left-hand member.

Figure 3:
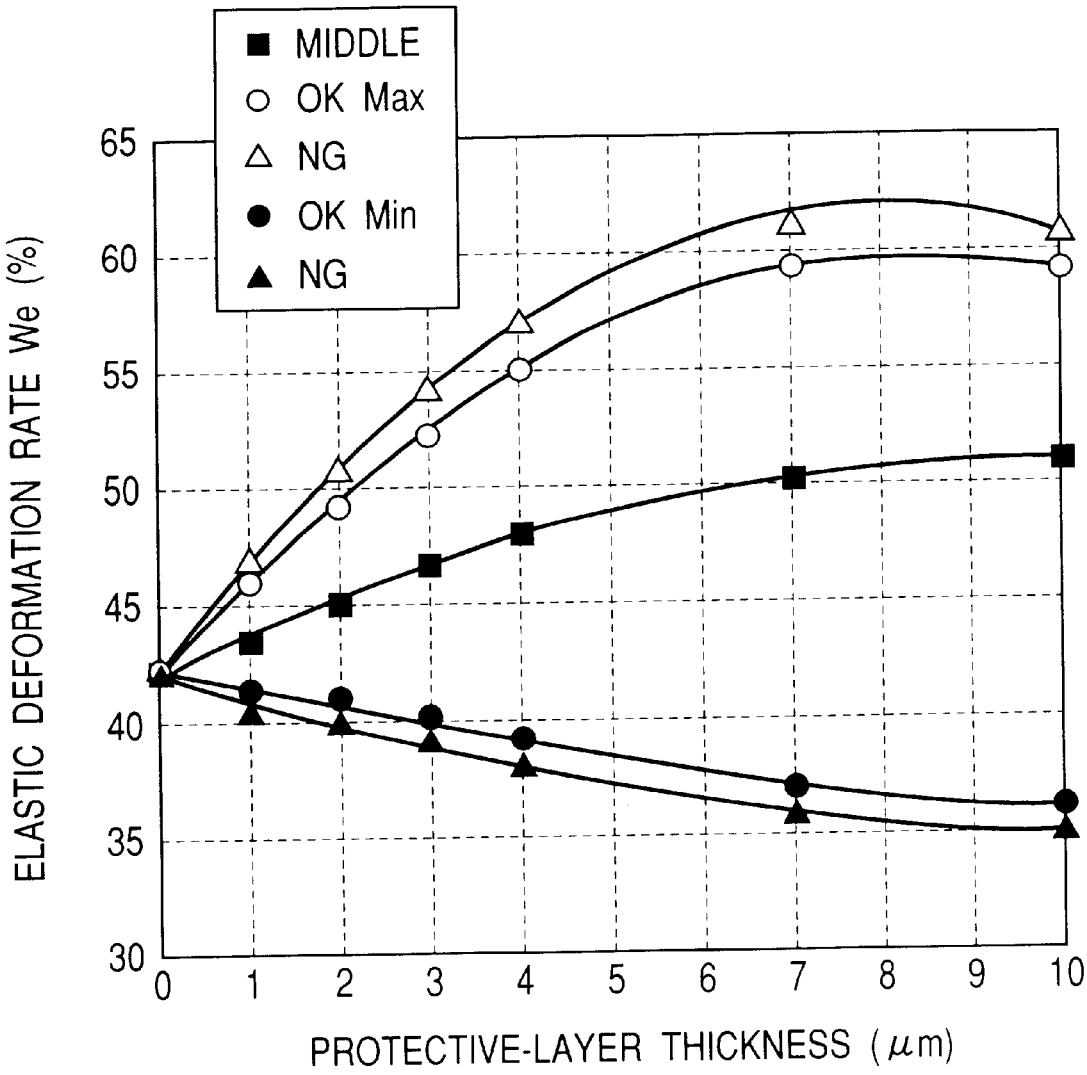
FIG. 3 is a chart showing moduli of elastic deformation measured on protective layers.

The elastic deformation rate We (%) of the protective layer is also shown in FIG. 3. The left-hand member ($-0.71\times d+We-2$) shown in the expression (2) is an approximate expression obtained from the results of Examples. This is a linear expression with respect to the layer thickness because the approximation was feasible in substantially straight lines up to 1 to 7 $\mu$m corresponding to the proper layer thickness of the protective layer. There is no problem when the elastic deformation rate We-1 (%) is in a value greater than the value of this left-hand member. If it is in a value smaller than that, the protective layer tends to be scratched because it is considerably brittler than the photosensitive layer.

There is no problem so much in a usual state even when the elastic deformation rate We-1 (%) is in a value greater than the value of the right-hand member ($-0.247\times d^2+4.19\times d+We-2$) shown in the expression (2). When, however, a contact charging assembly is left standing for about 30 days in a high-temperature high-humidity environment in contact with the protective layer, a dent may physically come to occur. In general, when the elastic area is large, the dent is liable to be restored, but it is unclear why such a dent occurs. However, it is presumed that when such contact is kept up on the thin-film protective layer under a certain pressure, even if the protective layer itself can be elastically deformed, the underlying photosensitive layer may become unable to follow the elastic deformation.

In the present invention, the protective layer may preferably contain conductive particles and lubricating resin particles.

The conductive particles used in the protective layer may include metal particles, metal oxide particles and carbon black. The metal may include aluminum, zinc, copper, chromium, nickel, silver and stainless steel. Plastic particles on the surfaces of which any of these metals has been vacuum-deposited may also be used. The metal oxide may include zinc oxide, titanium oxide, tin oxide, antimony oxide, indium oxide, bismuth oxide, tin-doped indium oxide, antimony- or tantalum-doped tin oxide, and antimony-doped zirconium oxide. Any of these may be used alone or in a combination of two or more types. When used in a combination of two or more types, they may merely be blended or may be made into solid solution or fused solid.

The conductive particles used in the present invention may preferably have a volume-average particle diameter of 0.3 $\mu$m or smaller, and particularly 0.1 $\mu$m or smaller, in view of transparency of the protective layer. Also, in the present invention, among the conductive particles described above, the use of metal oxides is particularly preferred in view of the transparency.

The lubricating resin particles used in the present invention may include fluorine-containing resin particles, silicon particles and silicone particles. In the present invention, fluorine-containing resin particles are particularly preferred. The fluorine-containing resin particles used in the present invention may include particles of tetrafluoroethylene resin, trifluorochloroethylene resin, hexafluoroethylene propylene resin, vinyl fluoride resin, vinylidene fluoride resin, difluorodichloroethylene resin and copolymers of these, any one or more of which may preferably appropriately be selected. Tetrafluoroethylene resin and vinylidene fluoride resin are particularly preferred. The molecular weight and particle diameter of the resin particles may appropriately be selected, without any particular limitations.

In order to keep particles of this fluorine-containing resin from agglomerating in a solution for forming the protective layer, it is preferable to add a fluorine-containing compound. Also, when the conductive particles are to be contained, the fluorine-containing compound may be added at the time the conductive particles are dispersed, or the conductive particles may be surface-treated with the fluorine-containing compound as a surface-treating agent. Compared with a case where no fluorine-containing compound is added, the addition of the fluorine-containing compound to the conductive particles or the surface treatment of the conductive particles with the fluorine-containing compound brings about remarkable improvement in dispersibility and dispersion stability of the conductive particles and fluorine-containing compound in the resin solution. Also, the fluorine-containing resin particles may be dispersed in a resin solution which the fluorine-containing compound has been added to and the conductive particles have been dispersed in, or in a resin solution in which the surface-treated conductive particles have been dispersed, thereby producing a protective-layer coating fluid free of formation of secondary particles of dispersed particles, very stable with the passage of time and good in dispersibility.

The fluorine-containing compound in the present invention may include fluorine-containing silane coupling agents, fluorine-modified silicone oils and fluorine-type surface-active agents. Examples of preferred compounds are given, but not limited thereto, in Tables 1 to 3 below.

TABLE 1

Examples of fluorine-containing silane coupling agents $CF_3CH_2CH_2Si(OCH_3)_3$
$C_{10}F_{21}CH_2CH_2SCH_2CH_2Si(OCH_3)_3$
$C_4F_9CH_2CH_2Si(OCH_3)_3$
$C_6F_{13}CH_2CH_2Si(OCH_3)_3$
$C_8F_{17}CH_2CH_2Si(OCH_3)_3$
$C_8F_{17}CH_2CH_2Si(OCH_2CH_2CH_3)_3$
$C_{10}F_{21}Si(OCH_3)_3$
$C_6F_{13}CONHSi(OCH_3)_3$
$C_8F_{17}CONHSi(OCH_3)_3$
$C_7F_{15}CONHCH_2CH_2CH_2Si(OCH_3)_3$
$C_7F_{15}CONHCH_2CH_2CH_2Si(OCH_2CH_3)_3$
$C_7F_{15}COOCH_2CH_2CH_2Si(OCH_3)_3$
$C_7F_{15}COSCH_2CH_2CH_2Si(OCH_3)_3$
$C_7F_{15}SO_2NHCH_2CH_2CH_2Si(OCH_3)_3$ $C_8F_{17}SO_2N(CH_2CH_3)CH_2CH_2CH_2Si(OCH_3)_3$ $C_8F_{17}CH_2CH_2SCH_2CH_2Si(OCH_3)_3$ $C_7F_{15}CON(COC_7F_{15})CH_2CH_2CH_2Si(OCH_2CH_3)_3$ $C_7F_{15}CON(SO_2C_8F_{17})CH_2CH_2CH_2Si(OCH_2CH_3)_3$

TABLE 2

Examples of fluorine-modified silicone oils

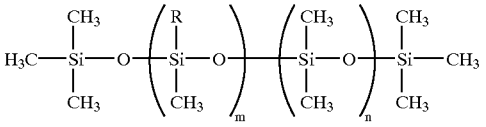

R: $—CH_2CH_2CF_3$
m & n: positive integers

TABLE 3

Examples of fluorine type surface-active agents $X—SO_2NRCH_2COOH$
$X—SO_2NRCH_2CH_2O(CH_2CH_2O)_nH$ (n = 5, 10, 15)
$X—SO_2N(CH_2CH_2CH_2OH)_2$
$X—RO(CH_2CH_2O)_n$ (n = 5, 10, 15)
$X—(RO)_n$ (n = 5, 10, 15)
$X—(RO)_nR$ (n = 5, 10, 15)

$X—SO_2NRCH_2CH(O)CH_2$

X—COOH, $X—CH_2CH_2COOH$
X—ORCOOH
$X—ORCH_2COOH$, $X—SO_3H$
$X—ORSO_3H$, $X—CH_2CH_2COOH$ $X—CH_2OCH_2CH(O)CH_2$ $X—CH_2CH_2OCH_2CH(O)CH_2$

TABLE 3-continued

Examples of fluorine type surface-active agents $X—CO_2CH_2CH(O)CH_2$

R: alkyl group, aryl group or aralkyl group.
X: fluorocarbon group such as $—CF_3$, $—C_4F_9$ or $—C_8F_{17}$.

As a method for the surface treatment of the conductive particles, the conductive particles and the surface-treating agent may be mixed and dispersed in a suitable solvent to make the surface-treating agent adhere to the conductive-particle surfaces. They may be dispersed by using a usual dispersion means such as a ball mill or a sand mill. Next, the solvent may be removed from the resultant dispersion to fix the surface-treating agent to the conductive-particle surfaces. After this treatment, heat treatment may further optionally be made. Also, in the surface-treating dispersion, a catalyst for accelerating the reaction may be added. Still also, the conductive particles having been surface-treated may further optionally be subjected to pulverization treatment.

The proportion (the surface treatment amount) of the fluorine-containing compound to the conductive particles depends on the particle diameter of the particles to be treated, and the fluorine-containing compound may be in an amount of from 1 to 65% by weight, and preferably from 1 to 50% by weight, based on the total weight of the conductive particles having been surface-treated. The surface treatment amount can be determined from the weight change after heating the surface-treated metal or metal oxide particles to 505° C. with TG-DTA (thermogravimetric differential thermal analysis), or from the weight change after heating at 500° C. for 2 hours in an ignition loss method making use of a crucible.

Thus, the dispersion of the fluorine-containing resin particles can be made stable by adding the fluorine-containing compound and thereafter dispersing the conductive particles or by using the conductive particles surface-treated with the fluorine-containing compound, so that a protective layer having superior slipperiness and releasability can be formed. However, a recent increasing trend toward higher running performance has come to require much higher hardness, higher print resistance and higher stability.

As a binder resin for the protective layer used in the present invention, a curable resin is preferred in view of high surface hardness and superior wear resistance. The curable resin may include, but not limited to, acrylic resins, urethane resins, epoxy resins, silicone resins and phenolic resins. In the present invention, curable phenolic resins are preferred, and resol-type phenolic resins are more preferred. Of the resol-type phenolic resins, from the viewpoint of environmental stability, preferred are those obtained using, as an alkaline catalyst used at the time of reaction of phenols with aldehydes, ammonia or an amine-type catalyst, and further in view of the stability of solution, an amine-type catalyst. The amine-type catalyst includes hexamethylenetetramine, trimethylamine, triethylamine and triethanolamine.

The above resins are resins containing a monomer or oligomer capable of curing by heat or light. The monomers or oligomers capable of curing by heat or light include, e.g., those having at the molecular terminal a functional group capable of causing polymerization reaction by the energy of heat or light. Of these, relatively large molecules having repeating units of about 2 to 20 in molecular structure are oligomers, and those having repeating units less than that are monomers. The functional group capable of causing polymerization reaction may include groups having a carbon—carbon double bond, such as an acryloyl group, a methacryloyl group, a vinyl group and an acetophenone group, silanol groups, those capable of causing ring-opening polymerization such as a cyclic ether group, and those capable of causing polymerization by the reaction of two or more types of molecules, e.g., phenol with formaldehyde. In the present invention, the term "curing" and other words related thereto refer to a state that a resin is not dissolved in an alcohol solvent such as methanol or ethanol.

In the present invention, in order to provide a protective layer having a higher environmental stability, a siloxane compound represented by Formula (1) below may further be added at the time the conductive particles are dispersed, or conductive particles having previously been surface-treated with this compound may further be mixed. This enables the protective layer having a higher environmental stability to be formed.

(1)

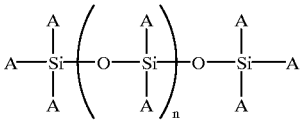

wherein A's are each a hydrogen atom or a methyl group, and the proportion of hydrogen atoms in all the A's is in the range of from 0.1 to 50% by weight; and n is an integer of 0 or more.

This siloxane compound may be added to the conductive particles and then dispersed, or conductive particles surface-treated with this compound may be dispersed in a binder resin dissolved in a solvent, thereby producing a protective-layer coating fluid free of any formation of secondary particles of dispersed particles, stable with the passage of time and good in dispersibility. Also, the protective layer formed using such a coating fluid can have a high transparency, and a film having especially good environmental resistance can be obtained. In addition, in the case of what is commonly called "hard but brittle resin" as in the case when the resin used in protective layers is the curable phenolic resin, streaky unevenness or cells may be seen to be formed in some cases as the protective layer is formed in a larger thickness, depending on the types of phenolic resins. However, the addition of the above siloxane compound or the use of the conductive particles surface-treated with this compound enables the streaky unevenness or cells to be kept from occurring, and an unexpected effect like a leveling agent is also obtainable.

There are no particular limitations on the molecular weight of the siloxane compound represented by Formula (1). However, when the conductive particles are surface-treated with it, it is better for the compound not to have too high viscosity in view of the readiness of surface treatment, and it is suitable for the siloxane compound to have hundreds to tens of thousands of weight-molecular weight.

As methods for the surface treatment, there are two methods, a wet process and a dry process. In the wet process, the conductive particles and the siloxane compound represented by Formula (1) are dispersed in a solvent to make the siloxane compound adhere to the particle surfaces. They may be dispersed by using a usual dispersion means such as a ball mill or a sand mill. Next, this dispersion is fixed to the conductive-particle surfaces by heat treatment. In this heat treatment, Si—H bonds in siloxane undergo oxidation caused by the oxygen in air in the course of the heat treatment to form additional siloxane linkages. As a result, the siloxane develops into three-dimensional network structure, and the conductive-particle surfaces are covered with this network structure. Thus, the surface treatment is completed upon fixing the siloxane compound to the conductive-particle surfaces. The particles having been thus treated may optionally be subjected to pulverization treatment. In the dry process, the siloxane compound and the conductive particles are mixed using no solvent, followed by kneading to fix the siloxane compound to the particle surfaces. Thereafter, as in the case of the wet process, the resultant particles may be subjected to heat treatment and pulverization treatment to complete the surface treatment.

The proportion of the siloxane compound to the conductive particles depends on the particle diameter of the conductive particles, and the siloxane compound may be in an amount of from 1 to 50% by weight, and preferably from 3 to 40% by weight, based on the weight of the conductive particles having been treated. A charge-transporting material may further be added to the protective-layer coating fluid containing the conductive particles.

In the case of a protective layer containing the charge-transporting material, usable charge-transporting materials include, but not limited to, hydrazone compounds, styryl compounds, oxazole compounds, thiazole compounds, triarylmethane compounds and triarylalkane compounds.

As a solvent for the protective-layer coating fluid, it may preferably be a solvent that does not adversely affect the charge transport layer described later with which the protective layer comes into contact. Accordingly, usable as the solvent are alcohols such as methanol, ethanol and 2-propanol, ketones such as acetone and MEK (methyl ethyl ketone), esters such as methyl acetate and ethyl acetate, ethers such as THF (tetrahydrofuran) and dioxane, aromatic hydrocarbons such as toluene and xylene, and halogenated hydrocarbons such as chlorobenzene and dichloromethane. Of these, solvents most preferable even in dip coating, which promises a good productivity, are alcohols such as methanol, ethanol and 2-propanol.

In the case when the protective layer in the present invention is of a heat-curing type, the protective layer is formed on the photosensitive layer by coating, followed by curing usually in a hot-air drying furnace or the like. This curing may by carried out at a temperature of from 100° C. to 300° C., and preferably from 120° C. to 200° C. Also, the protective layer may have a layer thickness of from 0.5 $\mu$m to 10 $\mu$m, and preferably from 1 $\mu$m to 7 $\mu$m.

In the present invention, additives such as an antioxidant may be incorporated in the protective layer.

The photosensitive layer is described below.

Figure 4A:
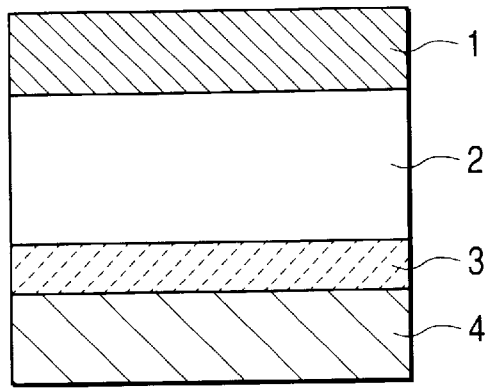
FIGS. 4A, 4B and 4C each illustrate the layer construction of the photosensitive member of the present invention.
Figure 4B:
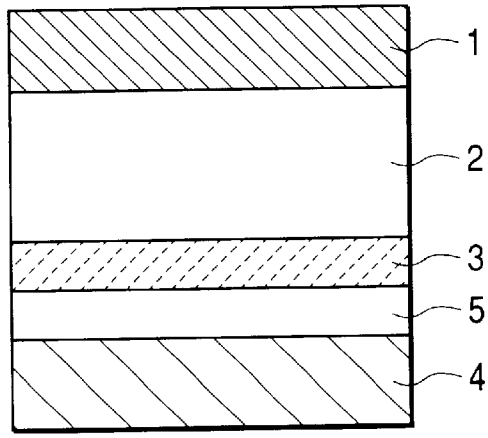
Figure 4C:
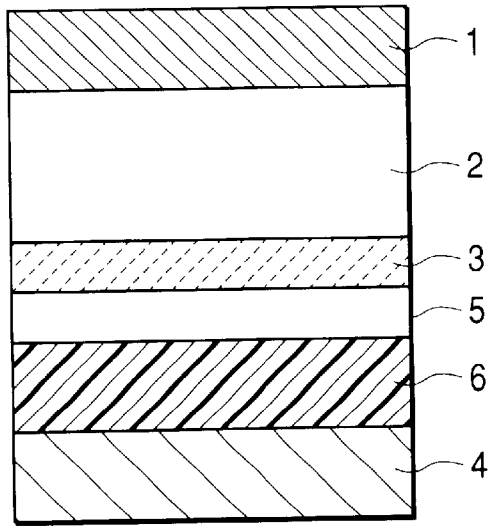

The photosensitive member of the present invention comprises a photosensitive layer having a multilayer structure. FIGS. 4A to 4C show examples thereof. The electrophotographic photosensitive member shown in FIG. 4A has a conductive support 4 and a charge generation layer 3 containing a charge-generating material and a charge transport layer 2 containing a charge-transporting material provided on the conductive support in this order, and a protective layer 1 further provided on the outermost surface. As shown in FIGS. 4B and 4C, a binding layer 5 and also a subbing layer 6 aiming at prevention of interference fringes may further be provided between the conductive support and the charge generation layer. Alternatively, at least the charge transport layer, the charge generation layer and also the protective layer may be provided in this order on the conductive support. Still alternatively, a photosensitive layer containing at least a charge-generating material and a charge-transporting material, what is called a single-layer photosensitive layer, may be provided on the conductive support and the protective layer may be formed thereon.

As the conductive support 4, usable are supports having conductivity in themselves as exemplified by those made of aluminum, aluminum alloy or stainless steel, and besides any of these supports on which a film has been formed by vacuum deposition of aluminum, aluminum alloy or indium oxide-tin oxide alloy, and supports comprising plastic or paper impregnated with conductive fine particles (e.g., carbon black, tin oxide, titanium oxide or silver particles) together with a suitable binder, and plastics having a conductive binder.

A binding layer (an adhesion layer) having the function as a barrier and the function of adhesion may be provided between the conductive support and the photosensitive layer. The binding layer is formed for the purposes of, e.g., improving the adhesion of the photosensitive layer, improving coating performance, protecting the support, covering defects of the support, improving the injection of electric charges from the support and protecting the photosensitive layer from electrical breakdown. The binding layer may be formed of, e.g., casein, polyvinyl alcohol, ethyl cellulose, an ethylene-acrylic acid copolymer, polyamide, modified polyamide, polyurethane, gelatin or aluminum oxide. The binding layer may preferably have a layer thickness of 0.5 $\mu$m or smaller, and more preferably from 0.2 to 3 $\mu$m.

The charge-generating material used in the present invention may include phthalocyanine pigments, azo pigments, indigo pigments, polycyclic quinone pigments, perylene pigments, quinacridone pigments, azulenium salt pigments, pyrylium dyes, thiopyrylium dyes, squarilium dyes, cyanine dyes, xanthene dyes, quinoneimine dyes, triphenylmethane dyes, styryl dyes, selenium, selenium-tellurium, amorphous silicon, cadmium sulfide and zinc oxide.

A solvent used for a charge generation layer coating fluid may be selected taking account of the resin to be used and the solubility or dispersion stability of the charge-generating material. As an organic solvent, usable are alcohols, sulfoxides, ketones, ethers, esters, aliphatic halogenated hydrocarbons or aromatic compounds.

To form the charge generation layer 3, the above charge-generating material may be well dispersed in a binder resin used in 0.3 to 4 times the weight of the charge-generating material together with a solvent, by means of a dispersion machine such as a homogenizer, an ultrasonic dispersion machine, a ball mill, a sand mill, an attritor or a roll mill, and the resultant dispersion is applied, followed by drying. It may preferably have a layer thickness of 5 $\mu$m or smaller, and particularly in the range of from 0.01 to 1 $\mu$m.

The charge-transporting material includes, but not limited to, hydrazone compounds, pyrazoline compounds, styryl compounds, oxazole compounds, thiazole compounds, triarylmethane compounds and polyarylalkane compounds.

The charge transport layer 2 may usually be formed by coating a solution prepared by dissolving the above charge-transporting material and a binder resin in the solvent. The charge-transporting material and the binder resin may be mixed in a proportion of from about 2:1 to about 1:2 in weight ratio. As the solvent, usable are ketones such as acetone, methyl ethyl ketone, esters such as methyl acetate and ethyl acetate, aromatic hydrocarbons such as toluene and xylene, and chlorinated hydrocarbons such as chlorobenzene, chloroform and carbon tetrachloride.

When coating fluids for forming these layers are applied, coating methods as exemplified by dip coating, spray coating and spin coating may be used. The drying may be carried out at a temperature ranging from 10° C. to 200° C., and preferably from 20° C. to 150° C., for a period of from 5 minutes to 5 hours, and preferably from 10 minutes to 2 hours, under air drying or natural drying.

The binder resin used to form the charge transport layer 2 may preferably be a resin selected from acrylic resins, styrene resins, polyester resins, polycarbonate resins, polyarylate resins, polysulfone resins, polyphenylene oxide resins, epoxy resins, polyurethane resins, alkyd resins and unsaturated resins. As the binder resin, particularly preferred is the use of polymethyl methacrylate, polystyrene, a styrene-acrylonitrile copolymer, polycarbonate resin and diallyl phthalate. The charge transport layer may usually preferably have a layer thickness of from 5 to 40 $\mu$m, and particularly preferably from 10 to 30 $\mu$m. However, from the viewpoint of image quality, a better dot reproducibility can be attained when the layer is made thinner. In particular, when phenolic resin is used in the protective layer, the image quality may abruptly deteriorate if the charge transport layer has a layer thickness of 25 $\mu$m or larger. Accordingly, the charge transport layer in the case where the phenolic resin is used in the protective layer may preferably have a layer thickness of from 5 $\mu$m to 24 $\mu$m, and, in order to lessen black dots under unfavorable conditions, e.g., in a high humidity environment, more preferably from 10 $\mu$m to 24 $\mu$m.

The charge generation layer or the charge transport layer may contain various additives such as antioxidants, ultraviolet absorbers and lubricants.

Figure 5:
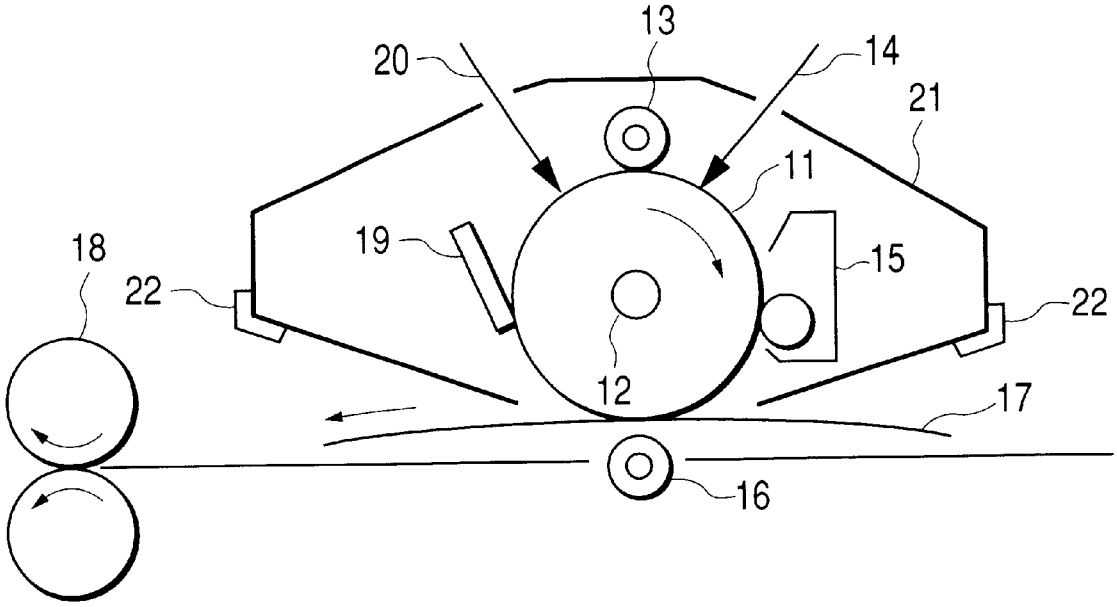
FIG. 5 is a diagrammatic cross-sectional view of an electrophotographic apparatus having the process cartridge of the present invention.

A specific example of an electrophotographic apparatus having a process cartridge employing the electrophotographic photosensitive member of the present invention is shown in FIG. 5. This apparatus is comprised of an electrophotographic photosensitive member 11, and a primary charging assembly 13, a developing assembly 15 and a transfer charging assembly 16 provided along its periphery. Reference numeral 14 denotes exposure light; and 12, a shaft.

Images are formed in the following way. First, a voltage is applied to the primary charging assembly 13 to charge the surface of the electrophotographic photosensitive member 11 electrostatically, and then the surface of the electrophotographic photosensitive member is subjected to exposure light 14 modulated in accordance with image signals corresponding to an original, forming an electrostatic latent image thereon. Next, a toner held in the developing assembly 15 is allowed to adhere to the electrophotographic photosensitive member 11 to develop (render visible) the electrostatic latent image on the electrophotographic photosensitive member to form a toner image. Subsequently, the toner image formed on the electrophotographic photosensitive member is transferred onto a transfer medium 17 such as paper fed from a paper tray (not shown), by means of the transfer charging assembly 16. The residual toner having remained on the electrophotographic photosensitive member without being transferred to the transfer medium 17 is collected by a cleaner. In recent years, researches are made on a cleanerless system, where the residual toner can directly be corrected at the developing assembly. The surface of the electrophotographic photosensitive member is subjected to charge elimination by pre-exposure light 20 emitted from a pre-exposure means (not shown), and thereafter repeatedly used for the next image formation. The pre-exposure means is not necessarily needed.

In the electrophotographic apparatus shown in FIG. 5, as a light source of the exposure light 14, a halogen lamp, a fluorescent lamp, a laser or an LED (light-emitting diode) may be used. Any other auxiliary process may also optionally be added.

In the present invention, the apparatus may be constituted of a combination of plural components integrally joined as a process cartridge from among the constituents such as the above electrophotographic photosensitive member 11, primary charging assembly 13, developing assembly 15 and cleaner 19 so that the process cartridge is detachably mounted on the body of the electrophotographic apparatus such as a copying machine or a printer. For example, at least one of the primary charging assembly 13, the developing assembly 15 and the cleaner 19 may integrally be supported in a cartridge together with the photosensitive member 11 to form a process cartridge 21 which is detachably mounted on the body of the apparatus through a guide means such as guide rails 22 provided in the body of the apparatus.

In the case when the electrophotographic apparatus is used as a copying machine or a printer, the exposure light 14 is light reflected from, or transmitted through, an original, or light irradiated by the scanning of a laser beam, the driving of an LED array or the driving of a liquid-crystal shutter array according to signals obtained by reading an original and converting the information into signals.

EXAMPLES

The present invention is described below in greater detail by giving Examples.

Examples 1 to 3

Here, aluminum cylinders of 30 mm×260.5 mm were used as supports. On each of the supports, a methanol solution of 5% by weight of a polyamide resin (trade name: AMILAN CM8000; available from Toray Industries, Inc.) was applied by dip coating, followed by drying to form a binding layer with a layer thickness of 0.5 μm.

Next, 4 parts (parts by weight; the same applies hereinafter) of an oxytitanium phthalocyanine pigment represented by the following structural formula:

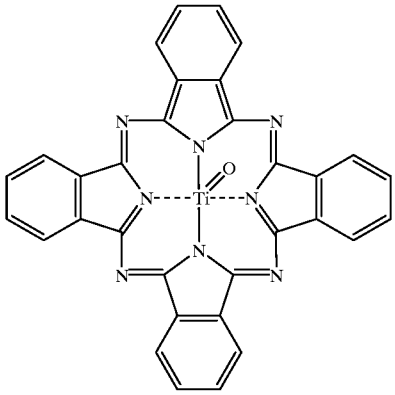

and having strong peaks at the diffraction angles (2θ±0.2°) of 9.0°, 14.2°, 23.9° and 27.1° in the CuKα characteristic X-ray diffraction pattern, 2 parts of polyvinyl butyral resin BX-1 (trade name; available from Sekisui Chemical Co., Ltd.) and 80 parts of cyclohexanone were dispersed for about 4 hours by means of a sand mill making use of glass beads of 1 mm diameter. The dispersion obtained was applied on the above binding layer, followed by drying to form a charge generation layer with a layer thickness of 0.2 μm.

Next, 10 parts of a compound represented by the following structural formula:

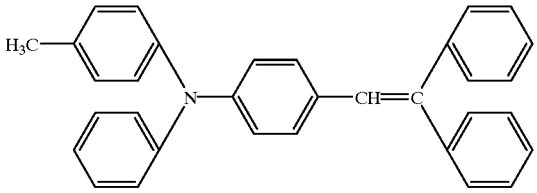

and 10 parts of bisphenol-Z polycarbonate (trade name: Z-200; available from Mitsubishi Gas Chemical Company, Inc.) were dissolved in 100 parts of monochlorobenzene. The resultant solution was applied on the above charge generation layer, followed by hot-air drying at 105° C. over a period of 1 hour to form a charge transport layer with a layer thickness of 20 μm.

Next, 20 parts of antimony-doped ultrafine tin oxide particles surface-treated with a fluorine-containing silane coupling agent (amount of treatment: 7%) represented by the following structural formula:

$$FC_3CH_2CH_2Si(OCH_3)_3$$

30 parts of antimony-doped fine tin oxide particles surface-treated with a silicone oil methylhydrogenpolysiloxane (trade name: KF99; available from Shin-Etsu Silicone Co., Ltd.) (amount of treatment: 20%) and 150 parts of ethanol were dispersed by means of a sand mill over a period of 66 hours, and 20 parts of fine polytetrafluoroethylene particles (average particle diameter: 0.18 μm) were further added, followed by dispersion for 2 hours. Thereafter, in the resultant dispersion, 30 parts of resol-type heat-curable phenolic resin (trade name: PL-4804; containing the amine-type catalyst; available from Gun-ei Chemical Industry Co., Ltd.; polyethylene-converted number-average molecular weight measured by gas permeation chromatography GPC: about 800) was dissolved as a resin component to prepare a coating fluid.

Using this coating fluid, a film was formed by dip coating on the charge transport layer previously formed, followed by hot-air drying at a temperature of 145° C. for 1 hour to form a protective layer. A plurality of samples having protective layers in different layer thickness were prepared. The layer thickness of each protective layer formed was measured with an instantaneous multiple photometric system MCPD-2000 (trade name; manufactured by Otsuka Denshi K.K.) utilizing interference of light because of thin film. The protective layer was 1 μm, 2 μm, 3 μm, 4 μm, 7 μm or 10 μm in thickness. (Cross sections of films of photosensitive members may directly be observed by, e.g., scanning electron microscopy SEM to make a measurement.) Also, the protective-layer coating fluid was in good dispersion and the film surface was unevenness-free and uniform surface.

The universal hardness Hu ($N/mm^2$) and elastic deformation rate We (%) were measured with the Fischer hardness meter (H100VP-HCU) stated previously. To measure the universal hardness, load was applied to the quadrangular-pyramid diamond indenter with an angle between its opposite faces of 136° to indent it by 1 μm depth into the film to be measured, and the indentation depth in a state of the load application was electrically detected and read out. The elastic deformation rate We (%) was obtained using the expression (4), from the work done We (nJ) for elastic deformation and the work done Wr (nJ) for plastic deformation as described previously. Its measurement was made 10 times, changing measuring positions for the same sample, and the value was found as an average of 8 points excluding the maximum value and the minimum value.

The universal hardness Hu-1 and elastic deformation rate We-1 (%) of the protective layer were directly measured on the protective layer of the electrophotographic photosensitive member. The universal hardness Hu-2 and elastic deformation rate We-2 (%) of the photosensitive layer were measured on the photosensitive layer after the protective layer was removed.

As a method for removing the protective layer, it was removed by rubbing with a lapping tape (trade name: C2000; available from Fuji Photo Film Co., Ltd.) by means of a drum-polishing apparatus manufacture by CANON INC. The method is by no means limited to this. The universal hardness and elastic deformation rate of the photosensitive layer may preferably be measured at a point of time where the protective layer is all removed, measuring the layer thickness successively so that the protective layer is not excessively polished up to the photosensitive layer as far as possible, and also observing the surface. However, it has been ascertained that, where the photosensitive layer has a residual layer thickness of 10 μm or larger, substantially the same values are obtainable. Thus, even when the photosensitive layer is excessively polished, substantially the same values are obtained as long as the photosensitive layer has a residual layer thickness of 10 μm or larger. However, it is preferable to make measurement in such a state that the protective layer is removed as far as possible and the photosensitive layer is not polished as far as possible.

To evaluate test results, the surface properties of the photosensitive member were visually observed, and thereafter images were reproduced by means of Laser Jet 4000 (trade name; manufactured by Hewlett Packard Co.; roller contact charging, and AC/DC application). To make evaluation, initial surface condition was observed, initial-stage images were evaluated, and also abrasion wear (μm) was measured and images were evaluated after 10,000-sheet running in an environment of 30° C./85% RH. Also, as a dent test, the charging roller was pressed against the surface of the electrophotographic photosensitive member under a pressure of about 5 kg, in the state of which these were left in an environment of 40° C./95% RH for a month. The universal hardness and elastic deformation rate were measured on protective layers of 1 μm, 2 μm, 3 μm, 4 μm, 7 μm and 10 μm in layer thickness. Actual-machine evaluation such as image evaluation, however, was made on those having protective layers of 1 μm, 3 μm and 7 μm in layer thickness (as Examples 1, 2 and 3, respectively). The results of measurement of the universal hardness and elastic deformation rate are shown in Table 4, and the results of other evaluation in Table 5. Incidentally, Hu-2 was 200 ($N/mm^2$) and We-2 was 42.0%.

Examples 4 and 5

The procedure of Example 2 was repeated except that the resol-type phenolic resin used in each protective layer was changed from PL-4804 to BSK-316 (trade name; available from Showa Highpolymer Co., Ltd.; containing the amine-type catalyst) and to the same PL-4804 but made to have a larger molecular weight of about 3,000 as measured by GPC, respectively.

Examples 6 and 7

The procedure of Example 5 was repeated except that the amount of the resin component to be added was changed from 30 parts to 50 parts and 100 parts, respectively.

Example 8

The procedure of Example 2 was repeated except that the binder resin Z-200 (viscosity-average molecular weight: 20,000) of the charge transport layer was changed to bisphenol-Z polycarbonate having a viscosity-average molecular weight of 100,000. Incidentally, Hu-2 was 220 ($N/mm^2$) and We-2 was 43.1%.

Examples 9 to 11

The procedures of Examples 1 to 3 were repeated, respectively, except that the amount of the antimony-doped ultrafine tin oxide particles surface-treated with a fluorine-containing silane coupling agent was changed from 20 parts to 50 parts and the antimony-doped fine tin oxide particles surface-treated with methylhydrogenpolysilioxane were not used.

Example 12

The procedure of Example 10 was repeated except that the resin used in the protective layer was changed from PL-4804 to BKS-316 and also the amount of the resin was changed from 30 parts to 15 parts.

Examples 13 to 15

In Examples 1 to 3, the protective layer was changed as described below. In 250 parts of ethanol, 70 parts of a charge-transporting material represented by the following structural formula:

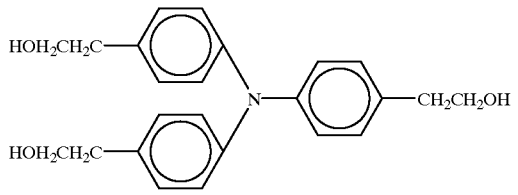

and as a resin component 100 parts of resol-type phenolic resin (trade name: PL-5294; metal-type catalyst, available from Gun-ei Chemical Industry Co., Ltd.) were dissolved. Also, in 20 parts of ethanol, 0.5 part of powder obtained by purifying a fluorine-containing compound (GF-300, trade name; available from Toagosei Chemical Industry Co., Ltd.) and 9 parts of polytetrafluoroethylene particles (LUBRON L-2, trade name; available from Daikin Industries, Ltd.) were dispersed for 2 hours by means of a paint shaker which held glass beads of 1 mm diameter. The resultant dispersion was added to the above solution prepared by dissolving the charge-transporting material and the resin, to obtain a protective layer coating fluid. The procedures of Examples 1 to 3 were repeated, respectively, except that each protective layer was formed using this coating fluid.

Comparative Examples 1 to 3

The procedures of Examples 1 to 3 were repeated, respectively, except that the phenolic resin used in the protective layer was changed to an acrylic monomer represented by the following structural formula:

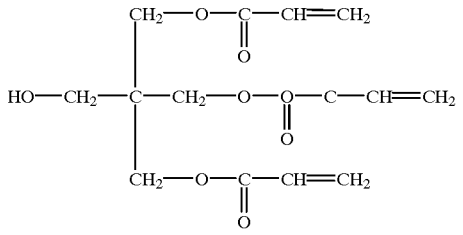

and as a photopolymerization initiator 6 parts of 2-methylthioxanthone was dissolved to prepare a coating fluid, which was then applied on the photosensitive layer by dip coating to form a film, followed by photocuring at a light intensity of 800 mW/cm$^2$ for 30 seconds by means of a high-pressure mercury lamp and further followed by hot-air drying at 120° C. for 100 minutes to form each protective layer.

Comparative Example 4

The procedure of Comparative Example 2 was repeated except that the amount of the acrylic monomer to be added was changed from 30 parts to 100 parts.

Comparative Example 5

The procedure of Example 2 was repeated except that the phenolic resin used in the protective layer was changed to methylphenylpolysiloxane (trade name: KF50500CS; available from Shin-Etsu Silicone Co., Ltd.).

Comparative Example 6

The procedure of Example 2 was repeated except that the conductive particles and polytetrafluoroethylene particles used in the protective layer were not contained and the phenolic resin was changed to methylphenylpolysiloxane (trade name: KF50500CS; available from Shin-Etsu Silicone Co., Ltd.) to form the protective layer using only the resin.

Comparative Example 7

In Example 13, the solvent for the protective-layer coating fluid was changed from ethanol to monochlorobenzene, the charge-transporting material used in the protective layer was changed to the same compound as that used in Example 1 and also the binder resin was changed from the phenolic resin to polycarbonate resin (trade name: Z-200; available from Mitsubishi Gas Chemical Company, Inc.) to prepare a coating fluid. The procedure of Example 13 was repeated except that this coating fluid was applied on the charge transport layer, followed by hot-air drying at 120° C. for 1 hour to form a protective layer.

Comparative Example 8

The procedures of Example 8 was repeated except that the phenolic resin used in the protective layer was changed to the same acrylic monomer as that used in Comparative Example 1, the amount for its addition was changed from 30 parts to 100 parts and as a photopolymerization initiator 6 parts of 2-methylthioxanthone was dissolved to prepare a coating fluid, which was then applied on the photosensitive layer by dip coating to form a film, followed by photocuring at a light intensity of 800 mW/cm$^2$ for 30 seconds by means of a high-pressure mercury lamp and further followed by hot-air drying at 120° C. for 100 minutes to form a protective layer.

Comparative Example 9

The procedure of Example 8 was repeated except that the phenolic resin used in the protective layer was changed to methyphenylpolysiloxane (trade name: KF50500CS; available from Shin-Etsu Silicone Co., Ltd.).

Comparative Example 10

The procedure of Example 8 was repeated except that the conductive particles and polytetrafluoroethylene particles used in the protective layer were not contained and the phenolic resin was changed to methylphenylpolysiloxane (trade name: KF50500CS; available from Shin-Etsu Silicone Co., Ltd.) to form the protective layer using only the resin.

The results of measurement and evaluation made in Examples 1 to 15 and Comparative Examples 1 to 10 are also shown in Tables 4 and 5.

As can be seen from Tables 4 and 5, in an electrophotographic photosensitive member comprising a conductive support and provided thereon a photosensitive layer and a protective layer, the electrophotographic photosensitive member in which the protective layer has a layer thickness of d ($\mu$m) and the universal hardness Hu-1 (N/mm$^2$) measured on the protective layer and the universal hardness Hu-2 (N/mm$^2$) of the photosensitive layer as measured after the protective layer is peeled satisfy the expression (1) set out previously can provide an electrophotographic photosensitive member which has a surface layer free of cracks and having a superior durability to the occurrence of surface wear and scratches, does not cause black dots upon running which are inherent in electrophotographic photosensitive members having protective layers, is tough to any deformation due to leaving in an environment of high temperature and high humidity, and can stably maintain a high-grade image quality. It can also provide a process cartridge and an electrophotographic apparatus which have such an electrophotographic photosensitive member and can stably maintain a high-grade image quality.

TABLE 4

| | Hu-1 | | | | | | | We-1 (%) | | | | | |
|---|---|---|---|---|---|---|---|---|---|---|---|---|---|
| Protective-layer thickness: | 1$\mu$m | 2$\mu$m | 3$\mu$m | 4$\mu$m | 7$\mu$m | 10$\mu$m | OK/NG | 1$\mu$m | 2$\mu$m | 3$\mu$m | 4$\mu$m | 7$\mu$m | OK/NG |
| Upper-limit value at Hu-2 = 200: | 242 | 272 | 311 | 338 | 390 | 390 | — | 45.9 | 49.4 | 52.3 | 54.8 | 59.2 | — |
| Lower-limit value at Hu-2 = 200: | 206 | 212 | 217 | 223 | 241 | 258 | — | 41.3 | 40.6 | 39.9 | 39.2 | 37 | — |
| Upper-limit value at Hu-2 = 220: | 262 | 292 | 331 | 358 | 410 | 410 | — | 47.0 | 50.1 | 53.4 | 55.9 | 60.3 | — |

TABLE 4-continued

| | Hu-1 | | | | | | | We-1 (%) | | | | | |
|---|---|---|---|---|---|---|---|---|---|---|---|---|---|
| Protective-layer thickness: | 1μm | 2μm | 3μm | 4μm | 7μm | 10μm | OK/NG | 1μm | 2μm | 3μm | 4μm | 7μm | OK/NG |
| Lower-limit value at Hu-2 = 220: | 226 | 232 | 237 | 243 | 261 | 278 | — | 42.4 | 41.7 | 42.0 | 40.3 | 38.1 | — |
| Example: | | | | | | | | | | | | | |
| 1–3 | 223 | 248 | 273 | 289 | 297 | 302 | OK | 43.2 | 45.4 | 47.2 | 48.6 | 50.1 | OK |
| 4 | 213 | 237 | 256 | 267 | 283 | 283 | OK | 42.2 | 44.1 | 46.3 | 47.2 | 49.5 | OK |
| 5 | 234 | 258 | 286 | 304 | 326 | 347 | OK | 43.6 | 45.7 | 47.6 | 48.7 | 50.4 | OK |
| 6 | 232 | 262 | 293 | 323 | 352 | 377 | OK | 45.2 | 47.3 | 49.5 | 52.3 | 56.4 | OK |
| 7 | 242 | 272 | 311 | 338 | 390 | 390 | OK | 45.9 | 49.4 | 52.3 | 54.8 | 59.2 | OK |
| 8 | 242 | 268 | 292 | 310 | 318 | 325 | OK | 44.3 | 46.3 | 48.4 | 49.7 | 51.3 | OK |
| 9–11 | 217 | 240 | 262 | 273 | 287 | 287 | OK | 42.1 | 44.3 | 46.2 | 47.4 | 49.3 | OK |
| 12 | 206 | 212 | 217 | 223 | 241 | 258 | OK | 41.3 | 40.6 | 39.9 | 39.2 | 39.2 | OK |
| 13–15 | 230 | 255 | 280 | 295 | 310 | 315 | OK | 45.3 | 47.5 | 49.3 | 52.6 | 56.4 | OK |
| Comparative Example: | | | | | | | | | | | | | |
| 1–3 | 202 | 205 | 208 | 213 | 222 | 230 | NG | 45.2 | 47.3 | 49.2 | 52.4 | 56.3 | OK |
| 4 | 203 | 208 | 213 | 218 | 233 | 245 | NG | 47.2 | 51.2 | 54.3 | 57.8 | 60.2 | NG |
| 5 | 251 | 300 | 328 | 362 | 411 | 415 | NG | 40.3 | 39.4 | 38.8 | 37.8 | 35.8 | NG |
| 6 | 262 | 312 | 341 | 375 | 426 | 430 | NG | 40.8 | 40.3 | 39.2 | 38.1 | 36.5 | NG |
| 7 | 200 | 200 | 200 | 200 | 200 | 200 | NG | 42.1 | 42 | 42.1 | 42.3 | 42 | OK |
| 8 | 223 | 226 | 227 | 235 | 244 | 252 | NG | 47.3 | 52.4 | 55.2 | 58.9 | 61.4 | NG |
| 9 | 272 | 322 | 346 | 380 | 432 | 436 | NG | 41.4 | 40.5 | 39.9 | 39 | 37.1 | NG |
| 10 | 284 | 335 | 364 | 397 | 448 | 453 | NG | 41.9 | 41.1 | 30 | 39.2 | 37.3 | NG |

TABLE 5

| | Initial-stage images | Abrasion wear after 10,000-sheet running | Images after running | Images after dent test | Initial-stage surface condition |
|---|---|---|---|---|---|
| Example: | | | | | |
| 1–3 | good | 0.5 | good | OK | good |
| 4 | good | 0.8 | good | OK | good |
| 5 | good | 0.4 | good | OK | good |
| 6 | good | 0.4 | good | OK | good |
| 7 | good | 0.3 | good | OK | good |
| 8 | good | 0.5 | good | OK | good |
| 9–11 | good | 0.5 | good | OK | Benard cells occur on 10 μm-thick product |
| 12 | good | 1.0 | good | OK | good |
| 13–15 | good | 0.7 | good | OK | good |
| Comparative Example: | | | | | |
| 1–3 | good | 0.6 | black dots | OK | good |
| 4 | good | 0.5 | black dots | NG | good |
| 5 | cracks | 0.9 | scratches | OK | cracks |
| 6 | cracks | 0.8 | scratches | OK | cracks |
| 7 | good | 10.0 | — | OK | good |
| 8 | good | 0.5 | black dots | NG | good |
| 9 | cracks | 0.9 | scratches | OK | cracks |
| 10 | cracks | 0.9 | scratches | OK | cracks |

What is claimed is:

1. An electrophotographic photosensitive member comprising a support, and a photosensitive layer and a protective layer which have been formed on the support in this order;

wherein a thickness d (μm) of said protective layer, a universal hardness Hu-1 (N/mm$^2$) of said protective layer, and a universal hardness Hu-2 (N/mm$^2$) of said photosensitive layer after peeling off said protective layer satisfy the following expression (1):

$$5.8\times d+Hu\text{-}2\leqq Hu\text{-}1\leqq -2.45\times d^2+44.4\times d+Hu\text{-}2 \quad (1).$$

2. An electrophotographic photosensitive member according to claim 1, wherein the thickness d (μm) of said protective layer, an elastic deformation rate We-1 (%) of said protective layer, and an elastic deformation rate We-2 (%) of said photosensitive layer after peeling off said protective layer satisfy the following expression (2):

$$-0.71\times d+We\text{-}2\leqq We\text{-}1\leqq -0.247\times d^2+4.19\times d+We\text{-}2 \quad (2).$$

3. An electrophotographic photosensitive member according to claim 1 or 2, wherein said protective layer contains conductive particles.

4. An electrophotographic photosensitive member according to claim 3, wherein said conductive particles are a metal oxide.

5. An electrophotographic photosensitive member according to claim 1 or 2, wherein said protective layer contains lubricating particles.

6. An electrophotographic photosensitive member according to claim 5, wherein said lubricating particles are fluorine-containing resin particles.

7. An electrophotographic photosensitive member according to claim 1 or 2, wherein said protective layer contains a curable resin.

8. An electrophotographic photosensitive member according to claim 7, wherein said curable resin is a heat-curable resin.

9. An electrophotographic photosensitive member according to claim 8, wherein said heat-curable resin is a phenolic resin.

10. An electrophotographic photosensitive member according to claim 9, wherein said phenolic resin is a resol-type phenolic resin.

11. An electrophotographic photosensitive member according to claim 10, wherein said resol-type phenolic resin is a resin synthesized using an amine compound.

12. An electrophotographic photosensitive member according to claim 1 or 2, wherein said protective layer has a layer thickness d of from 0.5 $\mu$m to 10 $\mu$m.

13. An electrophotographic photosensitive member according to claim 12, wherein said layer thickness d is from 1 $\mu$m to 7 $\mu$m.

14. A process cartridge comprising an electrophotographic photosensitive member and at least one means selected from the group consisting of a charging means, a developing means and a cleaning means;

said electrophotographic photosensitive member and at least one means being supported as one unit and being detachably mountable on the main body of an electrophotographic apparatus; and said electrophotographic photosensitive member comprising a support, and a photosensitive layer and a protective layer which have been formed on the support in this order;

wherein a thickness d ($\mu$m) of said protective layer, a universal hardness Hu-1 (N/mm$^2$) of said protective layer, and a universal hardness Hu-2 (N/mm$^2$) of said photosensitive layer after peeling off said protective layer satisfy the following expression (1):

$$5.8\times d+Hu\text{-}2 \leqq Hu\text{-}1 \leqq -2.45\times d^2+44.4\times d+Hu\text{-}2 \quad (1).$$

15. An electrophotographic apparatus comprising an electrophotographic photosensitive member, a charging means, an exposure means, a developing means and a transfer means;

said electrophotographic photosensitive member comprising a support, and a photosensitive layer and a protective layer which have been formed thereon in this order;

wherein a thickness d ($\mu$m) of said protective layer, a universal hardness Hu-1 (N/mm$^2$) of said protective layer, and a universal hardness Hu-2 (N/mm$^2$) of said photosensitive layer after peeling off said protective layer satisfy the following expression (1):

$$5.8\times d+Hu\text{-}2 \leqq Hu\text{-}1 \leqq -2.45\times d^2+44.4\times d+Hu\text{-}2 \quad (1).$$

* * * * *